US007195534B1

(12) United States Patent
Millman

(10) Patent No.: US 7,195,534 B1
(45) Date of Patent: Mar. 27, 2007

(54) SKIPPING TOY WITH EXTENDABLE RIBBON

(76) Inventor: Peter L. Millman, 122 Dog La., Storrs, CT (US) 06268

( * ) Notice: Subject to any disclaimer, the term of this patent is extended or adjusted under 35 U.S.C. 154(b) by 225 days.

(21) Appl. No.: 10/732,415

(22) Filed: Dec. 11, 2003

(51) Int. Cl.
*A63H 33/02* (2006.01)

(52) U.S. Cl. ..... 446/26; 446/236

(58) Field of Classification Search ..... 446/26, 446/236; 473/575, 576; 482/81
See application file for complete search history.

(56) References Cited

U.S. PATENT DOCUMENTS

| | | | | |
|---|---|---|---|---|
| 446,535 | A | 2/1891 | Outerbridge | |
| 1,214,863 | A | 2/1917 | Woeste | |
| 3,140,871 | A | 7/1964 | Liquori | |
| 3,528,654 | A | 9/1970 | Larson et al. | |
| 4,042,241 | A | 8/1977 | Collins | |
| 4,127,268 | A * | 11/1978 | Lindgren | 473/576 |
| D281,889 | S | 12/1985 | Bate et al. | |
| 4,601,474 | A | 7/1986 | Lew et al. | |
| 4,875,675 | A | 10/1989 | Arad et al. | |
| D309,484 | S | 7/1990 | Arad et al. | |
| 5,401,034 | A * | 3/1995 | Mallinger | 473/576 |
| 5,603,651 | A | 2/1997 | Shure et al. | |
| 5,813,931 | A * | 9/1998 | Gormley | 473/575 |
| 6,113,452 | A | 9/2000 | McGowan et al. | |
| 6,171,200 | B1 | 1/2001 | Camp | |
| 6,716,083 | B1 * | 4/2004 | Castro | 446/236 |
| 2003/0027484 | A1 | 2/2003 | Kessler | |

FOREIGN PATENT DOCUMENTS

| | | |
|---|---|---|
| EP | 0 384 953 | 9/1990 |

* cited by examiner

*Primary Examiner*—Kien Nguyen
(74) *Attorney, Agent, or Firm*—Fish & Richardson P.C.

(57) ABSTRACT

During play, a toy is rotated in a horizontal circular path about a player's ankle. The toy includes a collar and a housing connected to the collar by a tether. During play, the housing rotates about the player's ankle, while the player simultaneously hops or skips the tether. The housing contains a ribbon that is extendable from the housing to any one of a selected number of lengths. The length of the ribbon extended from the housing is directly proportional to a difficulty level of playing with the skipping toy in the manner described above. That is, the longer the ribbon, the faster a player must rotate the toy to avoid contact between the ribbon and a ground or playing surface. The ribbon may be automatically or manually retracted when the player wishes to do so.

25 Claims, 6 Drawing Sheets

SKIPPING TOY WITH EXTENDABLE RIBBON

TECHNICAL FIELD

This description relates to toys, and more particularly to skipping toys.

BACKGROUND

Conventional toys exist that include an element attached to a loop by a tether. A person plays with such a toy by, for example, loosely placing the loop around the ankle region of one of his or her legs, and then continuously moving the looped ankle in a small circular motion. In this way, the element horizontally revolves around the person's looped ankle, as long as the person raises the foot of his or her non-looped leg in a skipping or hopping motion during each revolution of the element, so as to avoid the tether as it moves with the element.

A person's ability to continuously twirl the element with one leg, while periodically raising the other leg so as not to impede the twirling of the element, provides an interesting game of physical dexterity and coordination.

SUMMARY

According to one general aspect, a toy includes a collar adapted to fit around an ankle region of a person, a tether having a first end attached to the collar, a housing attached to a second end of the tether, and an element associated with the housing and extendable from the housing.

Implementations may include one or more of the following features. For example, the housing may include an opening and the element may be within the housing and extendable through the opening.

The element may include a ribbon. In this case, the ribbon may be extendable to any one of a number of selectable lengths. Further, the toy may include a retracting mechanism operable to automatically retract the ribbon from a selected length. A button may be accessible from an exterior of the housing and operable to, when pressed, allow the ribbon to be automatically retracted from the selected length.

A retracting mechanism may be operable to manually retract the ribbon from a selected length. A spool casing may be within the housing, and a spool may be within the spool casing, wherein the ribbon is wound around the spool. In this case, the spool may include an interior portion and an exterior portion, and may further include a gear attached through the spool casing to the interior portion of the spool, and a return coil wound within the exterior portion and fastened at one end to the spool casing, wherein unwinding the ribbon places pressure on the return coil in a direction of turning the exterior portion to rewind the ribbon.

In this case, a return spring may be attached to an interior of the housing, outside of the spool casing, and a tooth may be included that is acted on by the return spring to be engaged with the gear, wherein engagement of the tooth with the gear prevents rewinding of the ribbon by the return coil. Further, a button may be accessible from the exterior of the housing, and an arm may be attached at one end to the tooth and the return spring, wherein pressing the button causes the button to come into contact with the arm and move the arm such that the tooth becomes disengaged from the gear, against an action of the return spring, such that the ribbon is re-wound by the return coil.

According to another general aspect, a toy includes a loop adapted to encircle an ankle region of a user, a housing associated with a ribbon, where the ribbon is adapted to extend from the housing during play, and a cord connecting the loop to the housing.

Implementations may include one or more of the following features. For example, the ribbon may be wound within the housing and adapted to be unwound to a selected length through an opening in the housing. In this case, a winding mechanism may be included that is operable to automatically rewind the ribbon from the selected length. Further, a button may be accessible from an exterior of the housing, wherein the button, when pressed, activates the winding mechanism to rewind the ribbon. Also, a manual winding mechanism may be included that is operable to rewind the ribbon from the selected length.

According to another general aspect, a toy includes a collar adapted to fit around an ankle region of a person, a tether having a first end attached to the collar, a housing attached to a second end of the tether, and means for increasing a difficulty level of rotating the housing about the ankle region.

Implementations may include one or more of the following features. For example, the means for increasing the difficulty level may include a strip within the housing that is extendable through an opening in the housing. In this case, the toy may include means for retracting the strip into the housing after the strip has been extended. Also, the strip may be extendable to any one of a plurality of selected lengths.

The details of particular implementations are set forth in the accompanying drawings and the description below. Other features will be apparent from the description and drawings, and from the claims.

DETAILED DESCRIPTION

Figure 1:
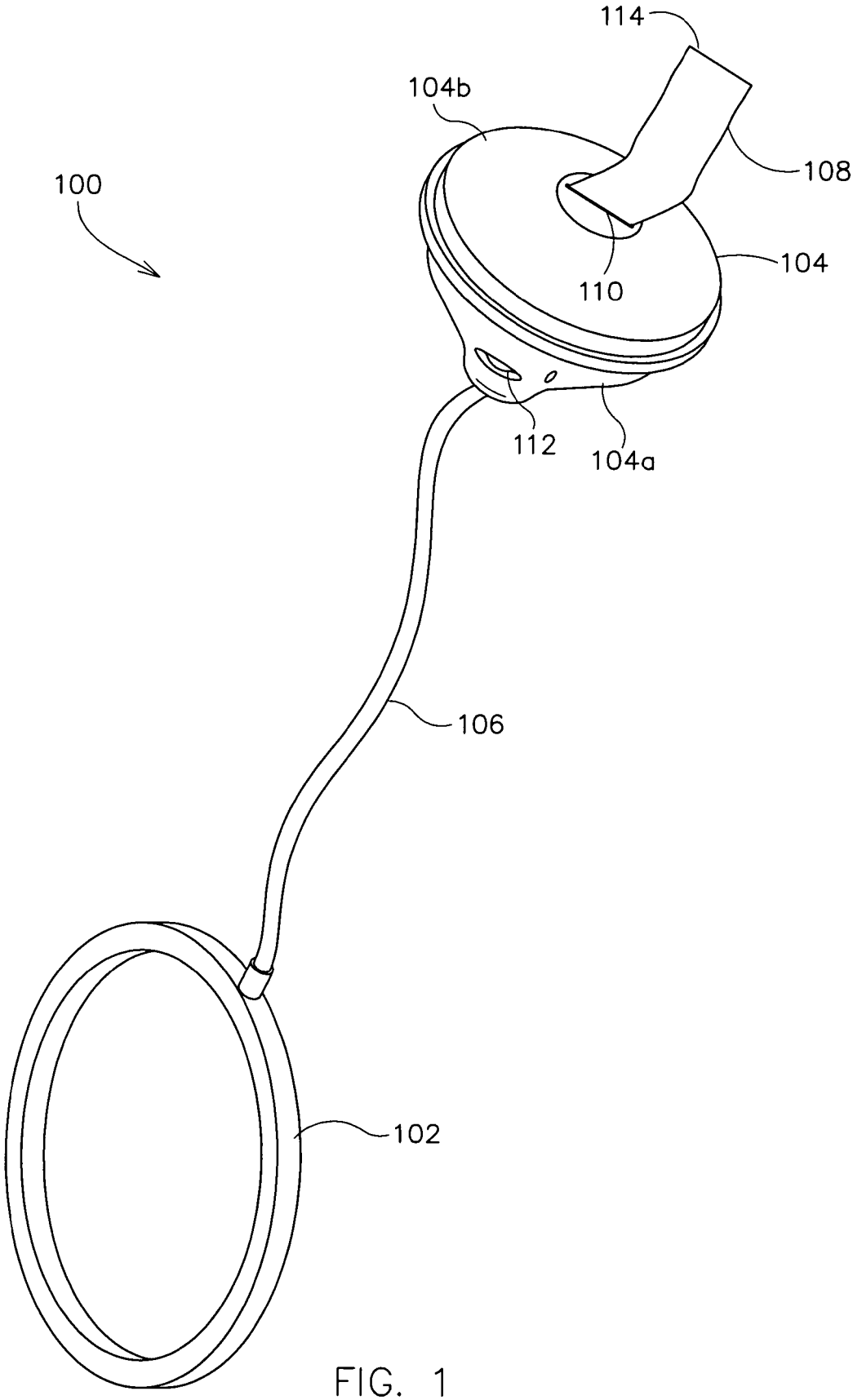
FIG. 1 is a perspective view of a skipping toy.

FIG. 1 is a perspective view of a skipping toy 100. In FIG. 1, the skipping toy 100 is illustrated as including a collar 102 connected to a housing 104. The collar 102 is suitably sized to allow a player to insert a foot therethrough, while allowing sufficient clearance about the ankle region of the player to avoid discomfort during play. The collar 102 may be made of, for example, any type of material that may be formed into a loop or circular shape for loose placement around an ankle region of a first leg of a player, as illustrated in FIG. 1. For example, the collar 102 may be formed of a plastic or rubber material. The collar 102 also may be referred to as a loop, ring, or other similar name.

The housing 104 is made of any suitable material that is sufficiently durable for use as a child's toy. The housing 104 may be opaque, or may be (or include) a transparent, semi-transparent, or translucent material. For example, the housing 104 may be formed of various types of plastic, may be completely transparent or translucent, and may be clear or colored (e.g., pink, blue, or green). The housing 104 also may be referred to as, for example, a drum or a container.

The housing may be integrally formed. In the implementation of FIG. 1, however, the housing 104 is formed of a first portion 104*a* and a second portion 104*b* that are snapped and screwed together. The housing portions also could be connected in other ways, such as through use of an adhesive. In FIG. 1, the portions 104*a* and 104*b* are substantially concave, but the portion 104*a* is deeper than the portion 104*b*.

A flexible, elongated tether 106 of a predetermined length interconnects the collar 102 with the housing 104. Other mechanisms for interconnecting the collar 102 and the housing 104 also may be used as the tether 106. For example, the tether 106 may represent a rope, cord, or any other material that permits the housing 104 to rotate around the first leg of the player, while simultaneously revolving around an axis defined by the tether 106 during its rotation around the first leg of the player. Also, as with the collar 102 and the housing 104, the tether 106 may be referred to by other names, such as, for example, a shaft or cord.

As referred to above, a player may operate the skipping toy 100 of FIG. 1 by placing the collar 102 around an ankle region of a first leg of the player, and then moving the first leg so as to induce a circular, rotating motion of the housing 104 around the ankle region. The player may maintain this circular motion indefinitely by periodically raising, skipping, hopping or otherwise moving the player's other leg out of the way of the tether 106 as the tether 106 and the housing 104 rotate.

The skipping toy 100 further includes an extendable ribbon 108 that is wound or otherwise contained within the housing 104. The ribbon 108 may be extended through an opening 110 in the second housing portion 104*b*, as shown in FIG. 1. As incremental lengths of the ribbon 108 are pulled from the housing 104, the ribbon 108 is prevented from retracting into the housing 104. In this way, a user may select a length of the ribbon 108 that is desired to be pulled from the housing 104.

In some implementations, the ribbon 108 may be incrementally extended from the housing 104, so as to provide a continuous or substantially continuous length selection to the user. In other implementations, the ribbon 108 may be pre-set to have a discrete number of selectable lengths.

The ribbon 108 may be made of a light-weight, flexible material, such as cloth or an appropriate plastic material, and may alternately be referred to as a strip or a band, or other appropriate name. During play, the ribbon 108 rotates along with the housing 104 about the looped leg of the user. Due to the light-weight, flexible nature of the ribbon 108, the housing 104 must be rotated about the looped leg of the user at a faster speed than would otherwise be necessary, in order to avoid contact between the ribbon 108 and a ground (playing) surface. In this way, a difficulty level of playing with the toy 100 may be increased, in that greater coordination, speed, and dexterity are required to keep the ribbon 108 from contacting the ground surface during play.

Based on the above, it should be understood that the more the ribbon 108 is extended from the housing 104, the more difficult it will be for the user to prevent the ribbon from contacting the ground during play. Since the ribbon 108 may be pulled to (and maintained at) any of a number of lengths, a difficulty level of playing with the toy 100 is easily adjustable for players' preferences and skill levels.

As a result, the toy 100 may be used during different types of games played by users. For example, users may compete to achieve a certain number of repetitions with the toy 100 when the ribbon 108 is at a selected length. As another example, players may compete with one another using ever-increasing lengths of the ribbon 108. As yet another example, the ribbon 108 may be used as a handicapping feature, so that players of different skill levels (e.g., an older child and a younger child) may compete with one another on an even playing field.

When a user is finished playing with the toy 100, or when the user wishes to retract the ribbon 108 to a reduced length, a button 112 may be pressed to automatically rewind or retract the ribbon 108. In one implementation, as long as the button 112 is pressed in, the ribbon is free to rewind. This automatic rewind feature permits easy and convenient use of the ribbon 108 with the toy 100. As discussed in more detail below with respect to FIGS. 6 and 7, other examples exist for rewinding or retracting the ribbon 108.

Also, a fold or other thickening technique may be applied to an end 114 of the ribbon 108 (shown more clearly in FIG. 2), so as to avoid a full rewinding of the ribbon 108 into the housing 104. In this way, the ribbon 108 may always be easily accessed by the user. In other implementations, a small plastic rod or other object may be sewn into the end 114 of the ribbon 108 to avoid rewinding of the ribbon 108 into an interior of the housing 104.

Figure 2:
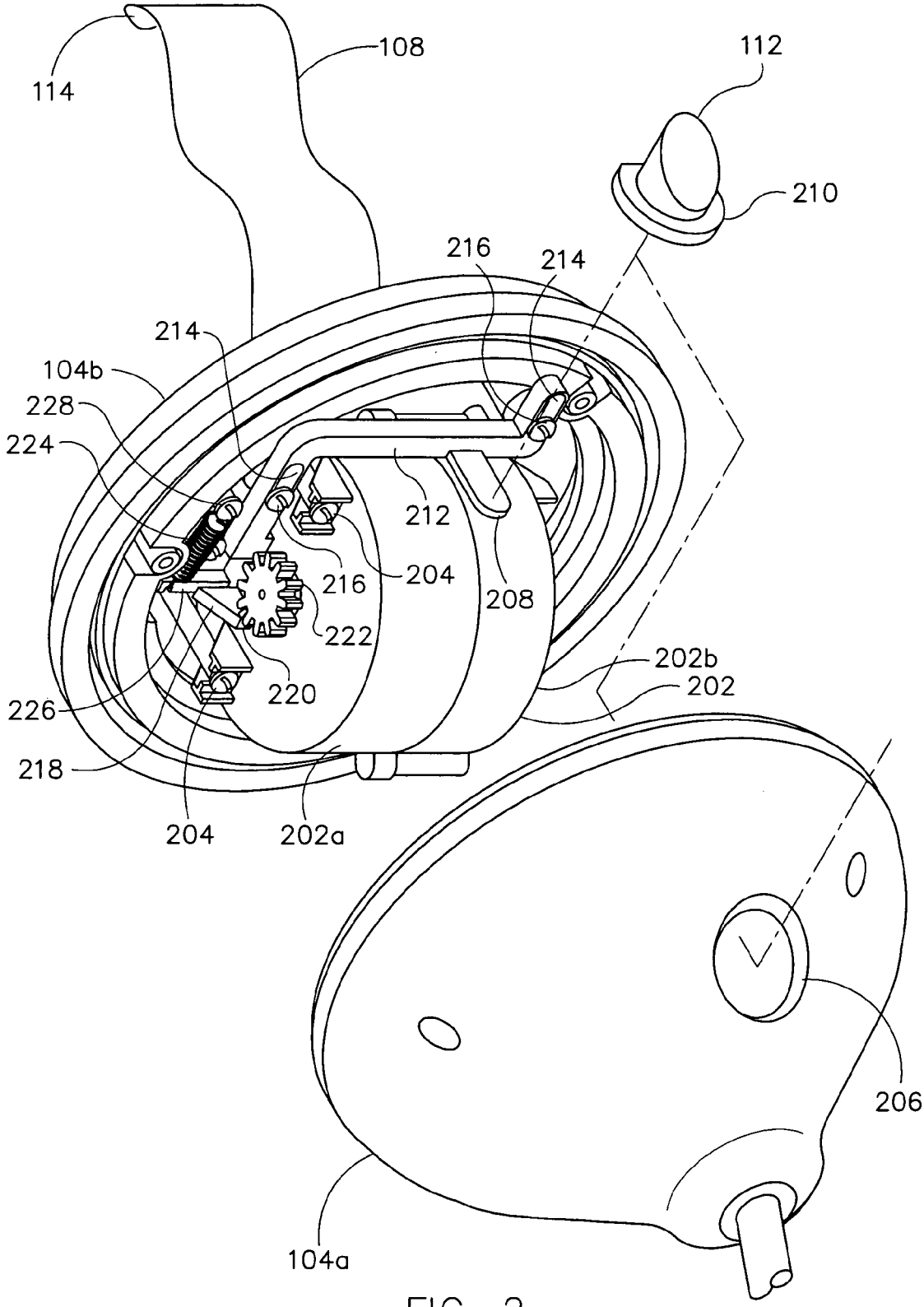
FIG. 2 is a perspective view of an interior of a housing of the skipping toy of FIG. 1, including a spool casing for winding an extendable ribbon.

FIG. 2 is a perspective view of an interior of a housing of the skipping toy of FIG. 1, including a spool casing 202 for winding the ribbon 108. The spool casing 202 includes a first portion 202*a* and a second portion 202*b*, where the two portions are fastened together by screws. The spool casing 202 itself is fastened to the housing portion 104*b* by screws 204, although, in either instance, other fastening techniques may be used.

In FIG. 2, the ribbon 108 is illustrated as having been pulled or extended to a selected length. When the user wishes to retract the ribbon 108, as described above, the user presses the button 112. As shown by the dashed line in FIG. 2, the button 112 is secured within an opening 206 in the housing portion 104*a*. More specifically, when the housing portions 104*a* and 104*b* are joined (e.g., screwed) together, a tab 208 presses against a rear surface of a base 210 of the button 112, such that the button base 210 is in contact with an interior circumference of the hole 206.

The tab 208 is attached to a bent arm 212. The bent arm 212 moves in conjunction with the pressing of the button 112, such that movement of the bent arm 212 is defined by slots 214 through which screws 216 are fastened. In other words, pressing the button 112 causes movement of the tab 208 along the same axis, which, in turn, causes movement of the bent arm 212 until the bent arm 212 is stopped in its motion when the screws 216 meet the ends of the slots 214.

At an end of the bent arm 212 farthest from the tab 208, a tooth support tab 218 is attached perpendicularly to the bent arm 212, and substantially parallel to the tab 208. The tooth support tab 218 supports a tooth 220 (shown more clearly in FIGS. 3 and 4) that engages a gear 222. A first end of a return spring 224 is connected with a spring support tab 226 that is itself attached to the bent arm 212, while a second end of the return spring 224 is attached to a screw 228.

Figure 3:
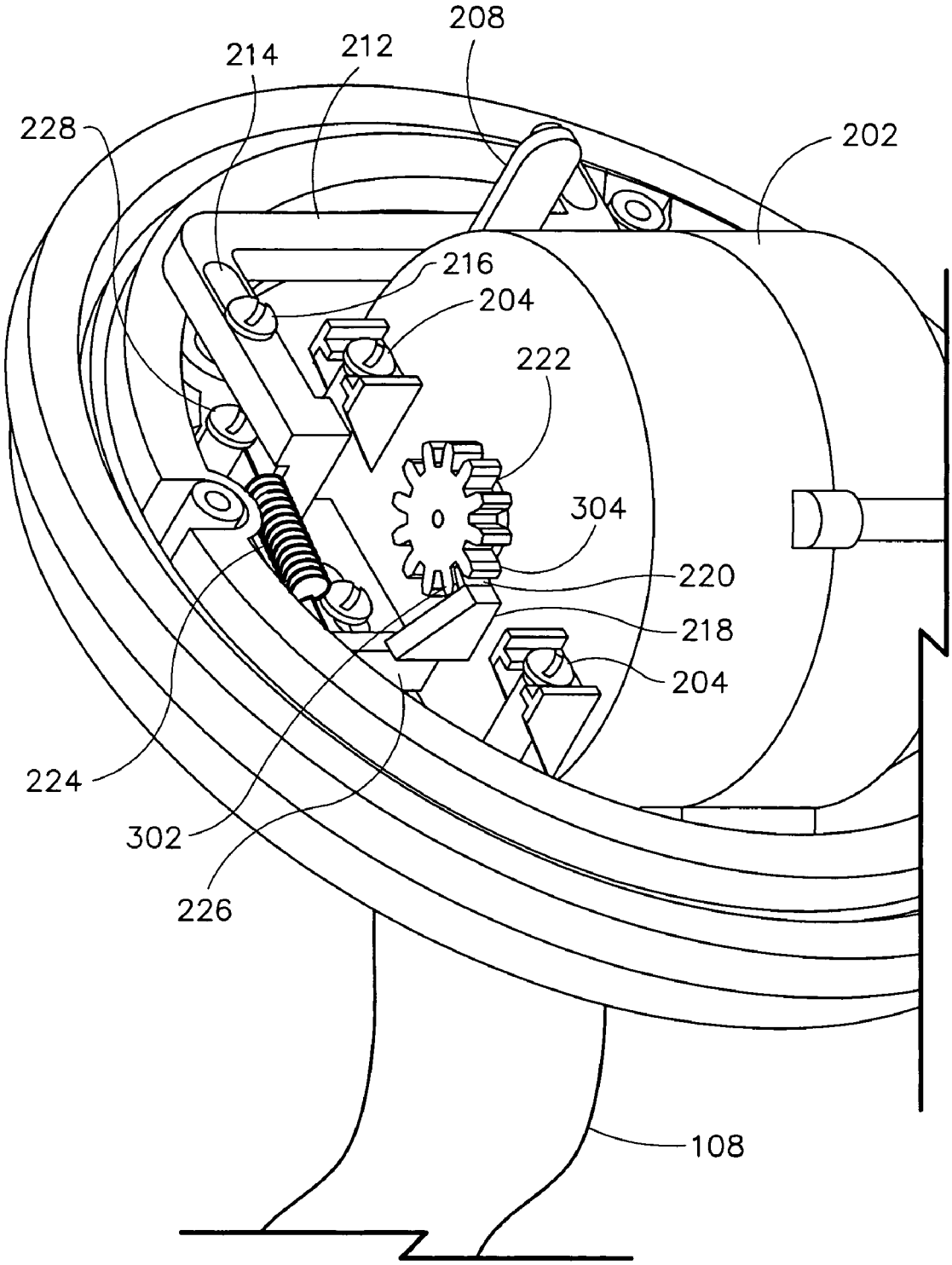
FIG. 3 is a magnified view of the perspective view of FIG. 2 from an altered viewing angle.
Figure 4:
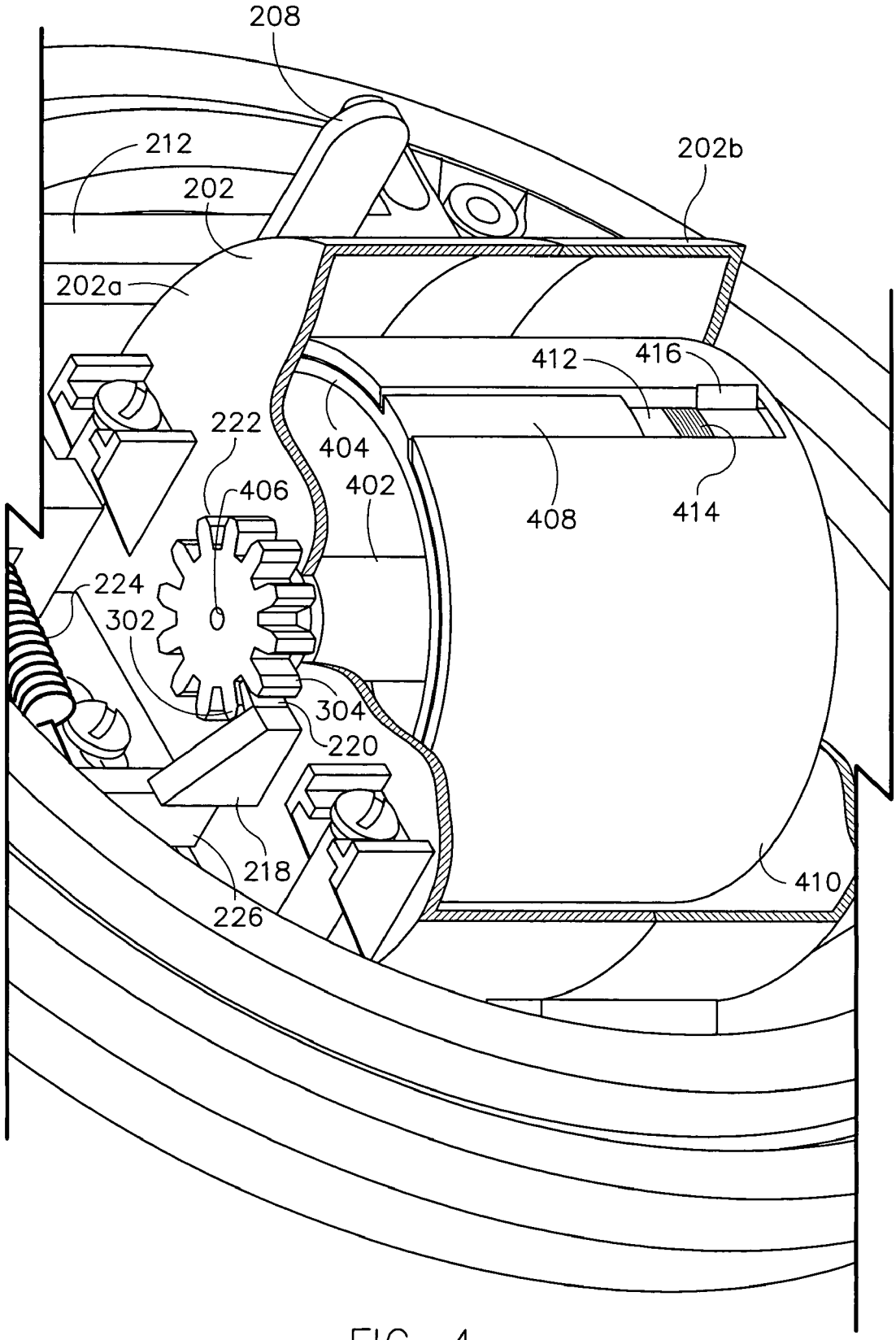
FIG. 4 is a cut-away view showing an interior of the spool casing of FIGS. 2 and 3, with the extendable ribbon removed.

As is apparent from the above discussion and from FIGS. 2–4, the return spring 224 is operable to engage the tooth 220 with the gear 222, unless and until the button 112 is pressed. When the button 112 is pressed, the bent arm 212 moves forward against the pressure of the return spring 224, disengaging the tooth 220 from the gear 222 as long as the button 112 is held in a pressed or engaged position.

Figure 5:
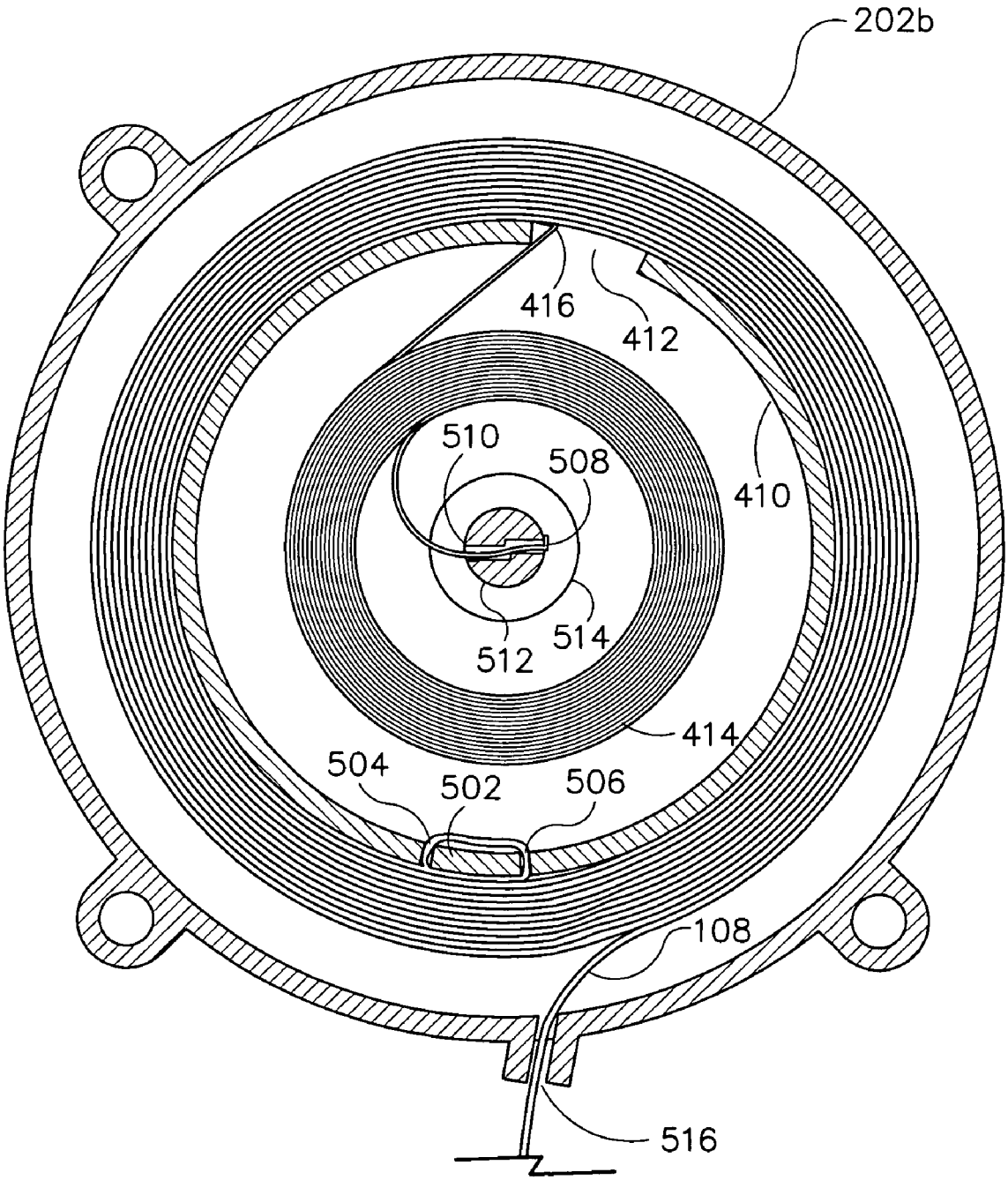
FIG. 5 is a side view of the interior of the spool casing of FIG. 4, with the extendable ribbon included.

During this time, the gear 222 is free to rotate. As shown in FIGS. 4 and 5 and discussed below, rotation of the gear 222 corresponds to a winding (or unwinding) of the ribbon 108. As a result, it can be seen that pressing the button 112 causes the ribbon 108, when extended, to retract into the housing 104.

FIG. 3 is a magnified view of the perspective view of FIG. 2 from an altered viewing angle. In FIG. 3, the tooth 220 is more easily seen in its engagement of the gear 222. When the ribbon 108 is unwound or extended from the housing 104, the force exerted by the user imparts a rotational force on the gear 222. In turn, the gear 222 imparts a force against the tooth 220, causing the tooth 220 to momentarily disengage from the gear 222, with much the same motion as that caused be the pressing of the button 112.

That is, in the implementation of FIGS. 2 and 3, a surface and/or angle of a gear tooth 302 (and all of the gear teeth) of the gear 222, relative to a contacted surface of the tooth 220 when the gear 222 is rotated, is such that rotating the gear 222 in an appropriate direction (e.g., counter-clockwise when looking at the gear 222 as shown in FIG. 3) causes a sliding motion along the surface of the tooth 220. As a result, the tooth 220 slips from the gear 222.

The return spring 224, as already described above, acts to ensure that the tooth 220 re-engages the gear 222 upon a completion (or pause) of pulling of the ribbon 108 by the user. Once the tooth is re-engaged in this situation, the now-contacted surface and/or angle of the tooth 220 and a gear tooth 304 is such that rotation of the gear in the opposite (i.e., clockwise) direction is prohibited from occurring (unless and until the button 112 is pressed by the user).

In short, the ribbon 108 ratchets outward as it is pulled by the user, and is maintained at whatever gear position it is located when the user stops pulling. In this way, the user has a wide range of choices as to a selected length of the ribbon 108. Other techniques may be used to provide similar results. For example, the tooth 220 and the gear 222 may be replaced by a pawl and ratchet gear, respectively, where such a pawl hinges or pivots relative to the ratchet gear to allow extension of the ribbon 108, but is held in place once the user stops extending the ribbon. As another example, the tooth 220 may be replaced by a flexible material that bends in a direction to allow un-winding of the ribbon 108.

FIG. 4 is a cut-away view showing an interior of the spool casing 202 of FIGS. 2 and 3, with the extendable ribbon removed. In FIG. 4, the gear 222 is shown to be attached to an axis 402, which is integrally joined with an interior spool portion 404. In one implementation, the gear 222 is joined to the axis 402 by a screw or other protrusion that is attached to the axis and extends through the spool casing portion 202*a* to be received by a hole 406 in the center of the gear 222. As a result of this construction, it should be apparent that rotation of the gear 222 in either direction causes a corresponding rotation of the interior spool portion 404.

The interior spool portion 404 includes a locking tab 408. The locking tab 408 connects the interior spool portion 404 to an exterior spool portion 410 by sliding into a slot 412 in the exterior spool portion 410. The locking tab 408 slides down the slot 412 and contacts a return coil 414, which is discussed in more detail below with respect to FIG. 5. A hooked end 416 of the return coil 416, as may be seen more clearly in FIG. 5, hooks around an edge of the slot 412 and secures the return coil 416.

Although not shown, the opposite side of the interior spool portion 404 includes a slot that is similar in size and shape to the locking tab 408 and slot 412, and that receives a mating portion of the exterior spool portion 410. As a result, as shown in FIG. 5, the interior spool portion 404 and exterior spool portion 410, around which the ribbon 108 is actually wound, are locked together.

FIG. 5 illustrates the slot 412 in the exterior spool portion 410, as well as a tab 502 defined by an opening 504 and an opening 506 in the exterior spool portion 410. The tab 502 and associated openings 504 and 506 serve to receive the slot on the underside of the interior spool portion 404 just mentioned, and also serve to secure an end of the ribbon 108.

Considering FIGS. 4 and 5, then, it may be seen that the interior spool portion 404 is inserted into and secured within the exterior spool portion 410. As a result, it may be seen that rotation of the interior spool portion 404 causes rotation of the axis 402, and turns the gear 222.

FIG. 5 illustrates the return coil 414 inside the exterior spool portion 410. The end 416 of the return coil 414, as already mentioned, is hooked onto, or otherwise attached to, the opening 412 between the exterior spool portion 410 and the ribbon 108. A second end 508 of the return coil 414 is threaded through a slot 510 in a post 512. In one implementation, the post 512 is formed integrally with the spool casing portion 202*b*, and extends through a hole 514 in the exterior spool portion 502.

Since the second end 508 of the return coil is held in place in the slot 510 while the first end 416 is hooked around the slot 412, a pulling or unwinding of the ribbon 108 from an opening 516 that aligns with the opening 110 in the housing 104 (e.g., ratcheting out the ribbon as described above) places pressure on the return coil 414. As a result, when the ribbon 108 is released (and unless it is held in place by the gear 222 and tooth 220 as already described) the ribbon 108 will automatically and fully rewind, until a fold or other stopping mechanism in the end 114 (see FIG. 1) of the ribbon stops the ribbon 108 at a position that leaves the ribbon 108 accessible from an exterior of the housing 104.

It should be understood that the interior spool portion 404, when inserted into the exterior spool portion 410, fits snugly against a top of the post 512. In this way, the second end 416 of the return coil is prevented from slipping out of the slot 412. Moreover, the return coil 414 is prevented from becoming unwound (i.e., individual windings of the return coil 414 are prevented from moving in a direction out of the paper in FIG. 5). As a result, the pressure (potential energy) placed on the return coil 414 by unwinding the ribbon 108 is ensured to be used in rewinding the ribbon 108 when the tooth 220 is disengaged from the gear 222 (i.e., when the button 112 is pressed).

The above description provides examples of a retracting or winding mechanism for unwinding and rewinding the ribbon 108. That is, such a winding mechanism may include all of the various features described above, both internal and external to the spool casing 202, that are involved in allowing the user to extend the ribbon while ensuring that the ribbon will be retracted when the button 112 is pressed. Other winding mechanisms also may be used. For example, a battery-operated winding mechanism may be used, or, as described below with respect to FIGS. 6 and 7, a manual winding mechanism may be used.

Figure 7:
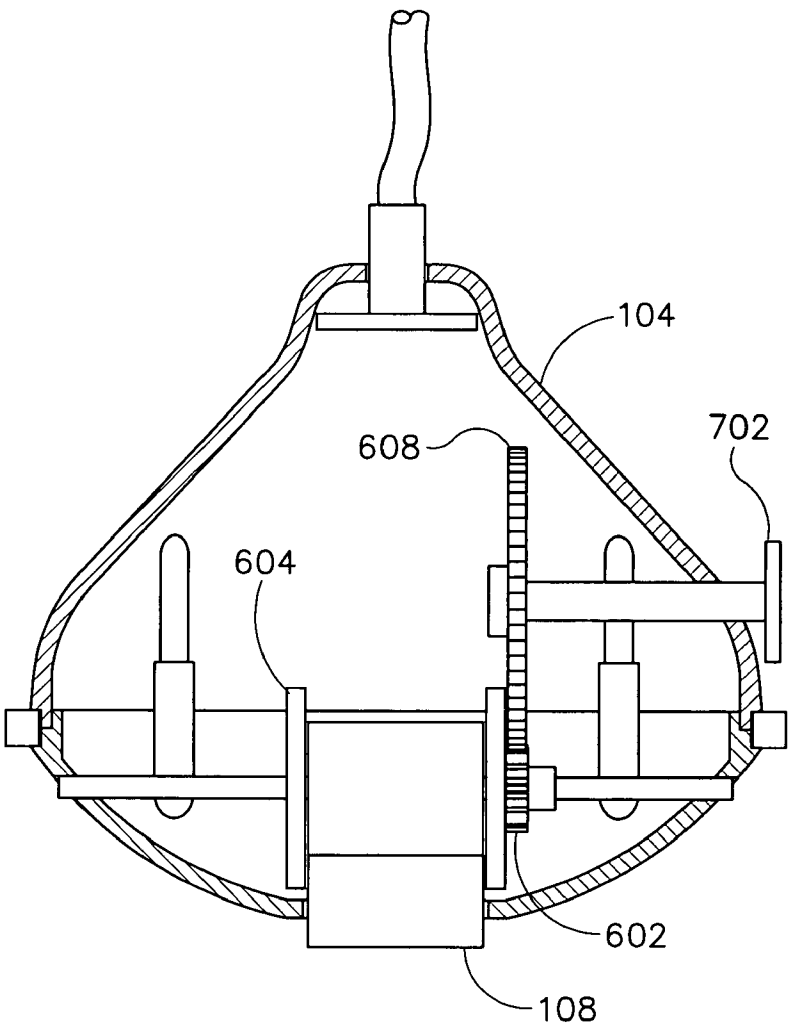
FIG. 7 is a second perspective view of the skipping toy of FIG. 6.
Figure 6:
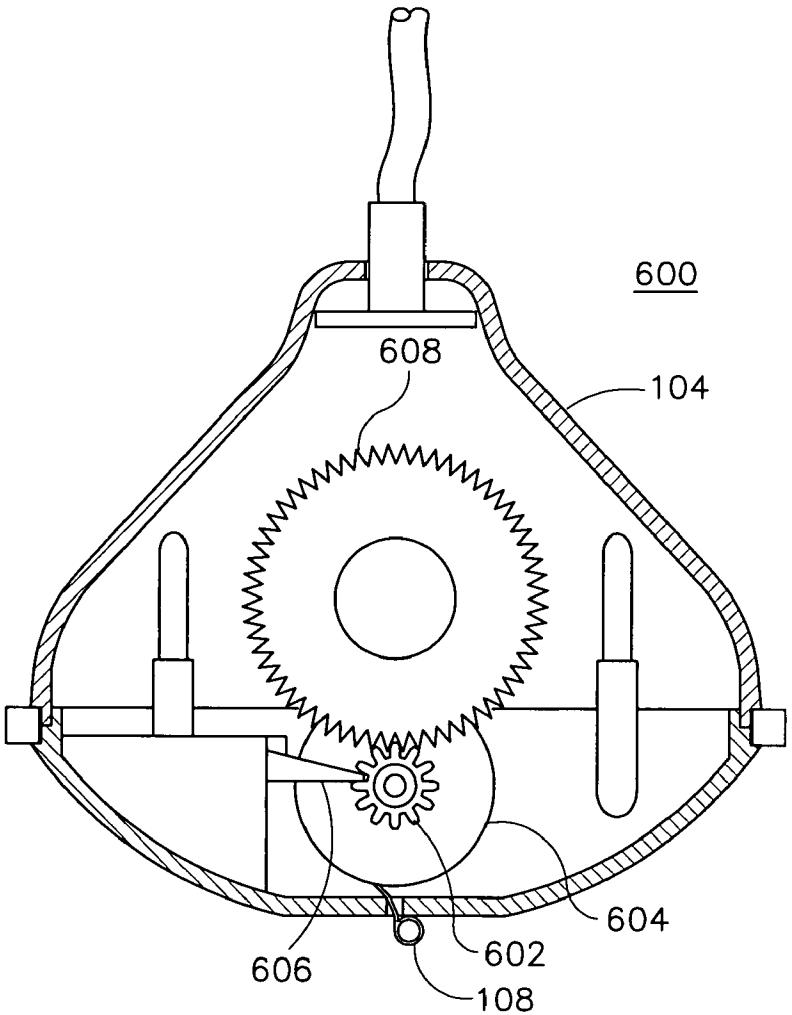
FIG. 6 is a first perspective view of another implementation of a skipping toy.

FIG. 6 is a first perspective view of another implementation of a skipping toy 600. In the toy 600, instead of the auto rewind feature described above, a manual rewind mechanism is employed. FIG. 7 is a second perspective view of the skipping toy 600 of FIG. 6, with the toy 600 being rotated 90°.

In FIGS. 6 and 7, when the ribbon 108 is being pulled or extended from the housing 104, a gear 602 attached to a spool 604 allows the ribbon 108 to ratchet out with respect to a tooth 606, in a somewhat similar manner as that described above with respect to tooth 220 and gear 222. In one implementation, the tooth 606 is sufficiently flexible (or hinged or pivoted) to permit motion of the gear 602 in either direction when force is applied to the gear 602. In this way, as described above, a user may select a number of possible lengths for extending the ribbon 108, resulting in corresponding levels of difficulty in playing with the toy 600.

When the user is finished playing with the toy 600, or wishes to reduce a level of difficulty of using the toy 600, the user may wind a knob 702 attached to a gear 608. Since the gears 608 and 602 are enmeshed, winding the knob 702 results in a turning of the gear 602, and corresponding winding of the ribbon 108 about the spool 604.

Although the above description provides examples of various automatic and manual winding techniques for a skipping toy with a retractable ribbon, it should be understood that various other techniques may be used to extend and retract such a ribbon. Moreover, any such skipping toy with an extendable and retractable ribbon may have various other features included.

For example, the housing 104 may take a number of shapes, including spherical, ellipsoidal, or jewel shaped. The housing 104 may have outer surfaces with multi-faceted arrangements that impart a jeweled appearance to the housing 104. The housing 104 may be transparent, semi-transparent, or translucent, or may contain additional openings that reveal an interior of the housing 104.

In the interior of the housing 104, various ornaments may be displayed, including, for example, a multi-faceted, reflective object or objects that may be substantially spherical in shape. Such an object may be disposed so as to rotate within (and independently of) the housing 104, and/or may rock back and forth (appearing to float) within the housing 104, thereby causing ambient light in an area of use of the skipping toy 100, such as sunlight, to be reflected in a dazzling, sparkling, or otherwise eye-catching manner.

In some implementations, a protective ring may be fixed about a periphery of the housing 104. Such a ring may be formed from, for example, a resilient elastomeric material that provides a skid-resistant contact surface about the periphery of housing 104. More specifically, such a ring may be formed about a perimeter of the housing 104 having the longest circumference of any perimeter of the housing 104, so as to ensure that the ring 202 remains in contact with the ground during play. To further ensure contact between the ring and the ground, the housing 104 may be additionally weighted.

A shaft connector may be connected to the tether 106 that extends through an opening in a base of the housing 104. In order to freely allow the rotation of the housing 104 along the ring during play with the skipping toy, the housing 104 may be free to rotate about the shaft connector.

A counter with a re-set button may be included within the housing. Such a counter may be designed to automatically count and visually display a number of rotations of the skipping toy 100 around a leg of the player. More specifically, during play, the protective ring referred to above may revolve along a ground surface. Thus, a number of revolutions of the ring that corresponds to a full rotation of the housing 104 around the ankle region of the player may cause the counter to increment once. An example of a counter/gear mechanism with appropriately-selected gear ratio(s) that may be used in conjunction with a skipping toy is illustrated in U.S. Pat. No. 4,875,675, which is hereby incorporated by reference in its entirety.

Adding such features to the skipping toys 100 or 600 having extendable ribbons, or similar skipping toys, may add enjoyment and/or a competitive nature to the skipping toy. More generally, as can be understood from the above description, the ability to rotate one foot in a manner imparting circular rotation to a skipping toy while simultaneously raising the other foot in a timely coordinated fashion, thereby allowing the toy to traverse a circular path which is generally centered about the ankle of the player, is not only challenging, but also improves a player's dexterity and coordination. Adding to this game the extendable and retractable ribbon described herein provides an aspect of increased and adjustable difficulty to the game, and allows users to play and/or compete with one another in an increased number of ways.

A number of implementations have been described. Nevertheless, it will be understood that various modifications may be made. For example, the implementations discussed above refer to a ribbon within a housing and extendable through an opening in the housing. However, in other implementations, the ribbon may be stored externally to the housing, so that no opening in required in the housing. For example, the ribbon may be attached to an exterior end of the housing on, for example, a spool, such as, for example, a retractable spool. Such an implementation may be useful, for example, when objects are contained within the housing, such as, for example, the reflective object discussed above. In still other implementations, the ribbon or similar element may have a fixed length and may simply be attached to an end of the housing. In such a case, a difficulty level of the toy may not be adjustable, or may be adjustable by folding the ribbon or other element in a predetermined way. Accordingly, other implementations are within the scope of the following claims.

What is claimed is:

1. A toy comprising:

a collar adapted to fit around an ankle region of a person;

a tether having a first end attached to the collar;

a housing attached to a second end of the tether; and an element associated with the housing and extendable from the housing;

wherein the element comprises an elongated flexible trailer element adapted to trail behind the housing during rotation of the housing around the ankle region of the person.

2. The toy of claim 1 wherein the housing includes an opening and the element is within the housing and extendable through the opening.

3. The toy of claim 1 wherein the element includes a ribbon.

4. The toy of claim 3 wherein the ribbon is extendable to any one of a number of selectable lengths.

5. The toy of claim 4 comprising a retracting mechanism operable to automatically retract the ribbon from a selected length.

6. The toy of claim 5 comprising a button accessible from an exterior of the housing and operable to, when pressed, allow the ribbon to be automatically retracted from the selected length.

7. The toy of claim 3 comprising a retracting mechanism operable to manually retract the ribbon from a selected length.

8. The toy of claim 3 comprising:

a spool casing within the housing; and a spool within the spool casing, wherein the ribbon is wound around the spool.

9. The toy of claim 8 wherein the spool comprises an interior portion and an exterior portion, and further comprising:

a gear attached through the spool casing to the interior portion of the spool; and a return coil wound within the exterior portion and fastened at one end to the spool casing, wherein unwinding the ribbon places pressure on the return coil in a direction of turning the exterior portion to rewind the ribbon.

10. The toy of claim 9 comprising:

a return spring attached to an interior of the housing, outside of the spool casing; and a tooth that is acted on by the return spring to be engaged with the gear, wherein engagement of the tooth with the gear prevents rewinding of the ribbon by the return coil.

11. The toy of claim 10 comprising:

a button accessible from the exterior of the housing; and an arm attached at one end to the tooth and the return spring, wherein pressing the button causes the button to come into contact with the arm and move the arm such that the tooth becomes disengaged from the gear, against an action of the return spring, such that the ribbon is re-wound by the return coil.

12. The toy of claim 1 wherein the element is retractable into the housing.

13. A toy comprising:

a loop adapted to encircle an ankle region of a user;

a housing associated with a ribbon, where the ribbon is adapted to extend from the housing during play; and a cord connecting the loop to the housing.

14. The toy of claim 13 wherein the ribbon is wound within the housing and adapted to be unwound to a selected length through an opening in the housing.

15. The toy of claim 14 comprising a winding mechanism operable to automatically rewind the ribbon from the selected length.

16. The toy of claim 15 comprising a button accessible from an exterior of the housing, wherein the button, when pressed, activates the winding mechanism to rewind the ribbon.

17. The toy of claim 14 comprising a manual winding mechanism operable to rewind the ribbon from the selected length.

18. The toy of claim 13 wherein the ribbon is extendable from, and retractable into, the housing.

19. A toy comprising:

a collar adapted to fit around an ankle region of a person;

a tether having a first end attached to the collar;

a housing attached to a second end of the tether; and means for increasing a difficulty level of rotating the housing about the ankle region.

20. The toy of claim 19 wherein the means for increasing the difficulty level includes a strip within the housing that is extendable through an opening in the housing.

21. The toy of claim 20 comprising means for retracting the strip into the housing after the strip has been extended.

22. The toy of claim 20 wherein the strip is extendable to any one of a plurality of selected lengths.

23. A toy comprising:

a collar adapted to fit around an ankle region of a person;

a tether having a first end attached to the collar;

a weighted element attached to a second end of the tether; and an elongated flexible trailer associated with the weighted element and operable to trail behind the weighted element during rotation of the weighted element around the ankle region.

24. The toy of claim 23 wherein the trailer is extendable from, and retractable into, the weighted element.

25. The toy of claim 23 wherein the weighted element comprises an outer peripheral edge that substantially rolls along a ground surface on which the person is standing during the rotation of the weighted element around the ankle region.

* * * * *